United States Patent [19]

von Braunhut

[11] Patent Number: 4,687,131

[45] Date of Patent: Aug. 18, 1987

[54] SPRING WHIP DEFENSIVE MECHANISM HAVING MEANS TO PERMIT DISASSEMBLY THEREOF

[76] Inventor: Harold von Braunhut, No. 1 Chapmans Landing Rd., Bryans Road, Md. 20616

[21] Appl. No.: 743,294

[22] Filed: Jun. 10, 1985

[51] Int. Cl.[4] ..... B68B 11/00; A45B 9/04; A63B 59/00

[52] U.S. Cl. ..... 231/2 R; 135/77; 273/84 R

[58] Field of Search ..... 135/75, 77, 78, 80, 135/86; 273/84 R, 84 ES; 231/2 R, 3, 4, 5, 6; 446/168

[56] References Cited

U.S. PATENT DOCUMENTS

| | | | |
|---|---|---|---|
| 483,931 | 10/1892 | Lanegan | 135/86 |
| 566,129 | 8/1896 | Bluett | 231/5 |
| 648,107 | 4/1900 | Hickman | 231/2 R |
| 815,458 | 3/1906 | Morris | 231/3 |
| 1,909,932 | 5/1933 | Digel | 273/84 R |
| 2,966,621 | 12/1960 | Voll | 273/84 R |
| 3,231,281 | 1/1966 | Wallo | 273/84 |
| 3,371,930 | 3/1968 | Shiga | 273/84 R X |
| 3,554,546 | 1/1971 | Braunhut | 231/2 |
| 4,037,839 | 7/1977 | Nelson | 273/84 R |
| 4,052,063 | 10/1977 | Wong | 273/84 R |
| 4,135,719 | 1/1979 | Braunhut | 231/2 X |
| 4,203,599 | 5/1980 | Starrett | 273/84 R |
| 4,394,016 | 7/1983 | Manos | 446/168 X |
| 4,456,255 | 6/1984 | Braunhut | 231/2 X |
| 4,533,140 | 8/1985 | Champion | 273/84 R |

FOREIGN PATENT DOCUMENTS

| | | | |
|---|---|---|---|
| 356481 | 7/1922 | Fed. Rep. of Germany | 273/84 R |
| 387597 | 7/1908 | France | 273/84 R |

*Primary Examiner*—Robert A. Hafer
*Assistant Examiner*—D. Neal Muir
*Attorney, Agent, or Firm*—Goodman & Teitelbaum

[57] ABSTRACT

A knock down spring whip assembly including a hollow housing which serves as a handgrip, and also stores a spring subassembly formed of lengths of helically wound springs of sequentially increasingly larger diameter size to move between a telescoped position within the housing and an extended whipping position projecting from one end of the housing with the springs wedgingly engaging each other in an end to end arrangement. A removable closure unit is provided for plugging the other end of the housing to define a storage compartment. The closure unit includes an integral magnet for retaining the spring subassembly in the telescoped position, where the closure unit can be replaced with other types of closure units. The housing includes a tapered end and an annular constriction for providing both a wedging engagement of the projecting springs as well as a positive locking action. Weighted ball bearings can be included within one of the springs for spiral rotation therethrough to provide an additional striking force. The striking spring can be replaced by a solid rod for an increased striking force. Preferably, the tip portion at the striking end is also removable to permit the spring whip assembly to be disassembled into its component parts.

19 Claims, 13 Drawing Figures

SPRING WHIP DEFENSIVE MECHANISM HAVING MEANS TO PERMIT DISASSEMBLY THEREOF

BACKGROUND OF THE INVENTION

The present invention relates to a self-defense weapon, and more particularly to a spring whip which can be conveniently carried by a user and can be readily available to be placed into a whipping position for emergency use, whereby the spring whip can be easily disassembled for repair, storage, and transportability.

With the continued increase in the crime rate, there is a need for effective defensive weapons. Although many such weapons are readily available, some require excessive time to place into an operative position and others are lethal and are therefore dangerous so as to be avoided by many people.

A particular type of useful defensive weapon which can be conveniently carried by a person and available for emergency situations is a spring whip. Such spring whip is described in my U.S. Pat. No. 3,554,546 as a device which is formed of interconnected lengths of spring. The diameters of the springs are of a sequentially increasing nature such that the springs can form a telescopic arrangement, and also permits storage of the springs within a housing. The springs can be easily placed into an extended whipping position projecting from the housing with the springs interconnected end to end to maintain their extended position for operative use.

An improved version of the spring whip is described in my U.S. Pat. No. 4,135,719. In this improved version, a weighted tip was added to the innermost, smallest diameter spring, serving both as a closure for the housing and also facilitating the projection of the springs into their extended whipping position. The improved spring whip also provided a magnet placed within a cap which serves to seal the housing with the magnet retaining the springs in their stored position. The springs are formed of magnetic attractive material.

Both of these aforementioned patents maintained the springs in their extended whipping position by having the inner ends of one connected spring outwardly flared, while the distal ends of the other connected spring were arranged with an inwardly tapered end, so as to effect a wedging engagement between the adjacent spring lengths A further improved version of the spring whip has been described in my U.S. Pat. No. 4,456,255, wherein the lengths of springs were alternately wound in opposing clockwise and counter clockwise directions in order to improve the movement of the springs between a retracted telescoped position and an extended position without locking the springs during such movement, and in order to improve the wedging engagement between the adjacent springs in their extended position. Additionally, an assortment of extension members were described for threading onto a sealing cap on the spring whip to provide additional defensive capabilities to the defensive weapon.

While each of these various spring whips have been found to be highly effective and of great use, additional improvements would be desirable. All of the prior art whips were entirely sealed, thereby preventing easy replacement of a damaged part. Because they were sealed, they could not be reduced to a knock down state and disassembled to permit easy transportability of its component parts.

Additionally, while the aforementioned wedging action adequately served to place the extended lengths of springs in a projected position, pressure upon the distal end of the extended springs may serve to collapse the springs, and thereby prevent striking capabilities of the device. There is, accordingly, needed a releasable locking mechanism which can lock the extended lengths of springs in their whipping position and prevent their collapsing.

In the spring whip described in my U.S. Pat. No. 3,554,546, there is included a series of weights disposed within one of the springs to add additional striking force to the spring. These weights were free to slide within the spring and, accordingly, could slide away from the striking end at the moment of striking, and would therefore not always provide the striking force intended.

Accordingly, further improvements to the spring whip defensive weapon of the aforementioned prior art patents is warranted to further enhance the efficiency and capabilities of such defensive weapons.

SUMMARY OF THE INVENTION

Accordingly, it is an object of the present invention to provide an improved spring whip which avoids the aforementioned problems of the prior art devices and which provides for a defensive weapon of improved capabilities.

Yet another object of the present invention is to provide a spring whip defensive weapon which can be easily disassembled into its component parts in order to permit easy replacement of broken or damaged parts.

A further object of the present invention is to provide a knock down spring whip as a defensive weapon which permits disassembly of the spring whip in order to provide transportability of the separate parts of the defensive weapon.

A further object of the present invention is to provide a spring whip defensive weapon including a plurality of lengths of springs which include both a wedging engagement arrangement as well as a locking arrangement, to secure the extended lengths in their whipping position.

Another object of the present invention is to provide a spring whip defensive weapon including a locking mechanism to releasably lock the projected weapon in its striking position.

Another object of the present invention is to provide a spring whip defensive weapon including a unitary removable end closure member which can be removed for replacement of the component parts, which permits connection of other defense mechanisms to the spring whip housing.

A further object of the present invention is to provide a spring whip defensive weapon which can be easily disassembled, and includes a removable striking tip which can be easily separated for replacement of parts as well as for transporting the separate parts of the spring whip.

Still a further object of the present invention is to provide a spring whip defensive weapon which includes a combination of telescoped springs and rods which can be secured within a housing in its retracted position, and can be easily projected into an extended whipping position.

Yet another object of the present invention is to provide a spring whip defensive weapon which includes a pocket clip for retaining the defensive weapon, and includes securement means for preventing the pocket clip from sliding along the spring whip housing.

Still another object of the present invention is to provide a spring whip defensive weapon having an improved housing with an improved outer surface for gripping of the weapon.

Briefly, in accordance with the present invention, there is provided a knock down spring whip assembly including a hollowhousing which serves as a handgrip and also provides an internal storage compartment. Plural lengths of helically wound springs of sequentially increasingly larger diameter size are provided. The springs are telescoped into a coaxial spring subassembly which is slidably insertable into the storage compartment. A wedging arrangement is associated with opposing ends of adjacent springs for maintaining the springs in an extended whipping position projecting from one end of the storage compartment. The spring subassembly is separable into its component springs when required.

The extended springs are retained within the housing by means of a constraining portion provided at the end of the housing from which the springs project. At the opposing end, the end into which the springs are inserted and can be extracted, there is provided a removable closure unit which serves to plug the opposing end of the housing. The closure unit includes a magnetic retaining member for normally retaining the spring subassembly in its retracted telescopic arrangement when stored within the storage compartment.

The distal end of the smallest diameter spring includes a projecting threaded stud which engages in a threaded hole of a removable weighted tip. The tip serves to close off the constraining end of the housing, and also provides an additional striking force during operative use of the spring whip.

The constraining end of the housing includes an inwardly tapering portion for wedging engagement of the largest diameter spring to prevent its separation from the housing when in the extended whipping position. In addition, there is provided an annular constriction projecting into the storage compartment adjacent to the constraining end. The proximal end of the largest diameter spring is outwardly flared such that at least one loop turn of the proximal end has an interference fit with the annular constriction, thereby requiring a forwardly directed axial force from the spring to compress the one loop turn beyond the annular constriction and lock it in place. Rotation of the larger diameter spring in the direction of its winding serves to release the one loop turn from the annular constriction to unlock the spring.

In an embodiment of the present invention, the smallest diameter spring length can also include a plurality of weighted bearings sized to track the grooves between adjacent loop turns in the hollow interior of the spring, and thereby follow the helical path of the spring as they move from one end of the spring to the other. This provides a time delay in the movement of the weighted bearings from one end of the spring to the other to provide an additional striking force at the striking end.

In an embodiment of the present invention, at least one of the spring lengths, and especially the striking spring, can be replaced by a solid rod to provide an additional striking force. The presence of the other lengths of spring serves to retain the spring effect of the weapon.

In an embodiment of the present invention, the closure member which closes off the non-constricting end of the housing, can be replaced by other closure units to provide additional defensive mechanisms to the spring whip. Each of the additional defensive closure units would compositely include its own retaining magnet as part of the unit.

BRIEF DESCRIPTION OF THE DRAWINGS

With the above and additional objects and advantages in view, as will hereinafter appear, this invention comprises the devices, combinations and arrangements of parts hereinafter described, by way of example, and illustrated in the accompanying drawings of a preferred embodiment in which.

In the various figures of the drawing like reference characters designate like parts.

DESCRIPTION OF THE PREFERRED EMBODIMENTS

Figure 1:
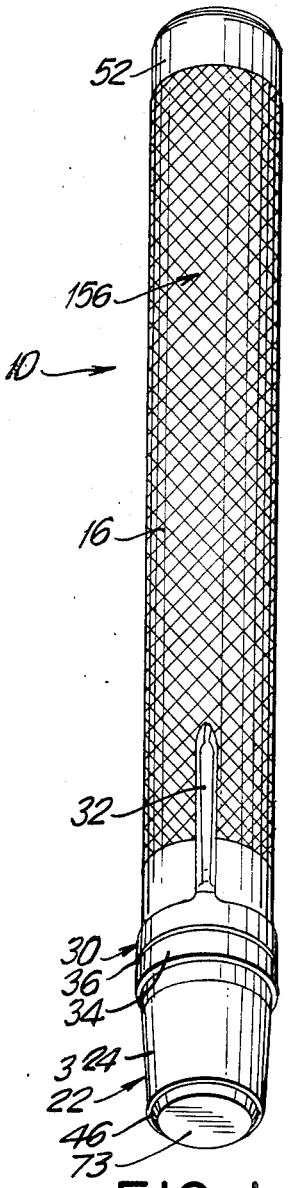
FIG. 1 is a perspective view of the defensive weapon of the present invention, with the spring lengths thereof being in their storage positions within the hand grip housing.
Figure 2:
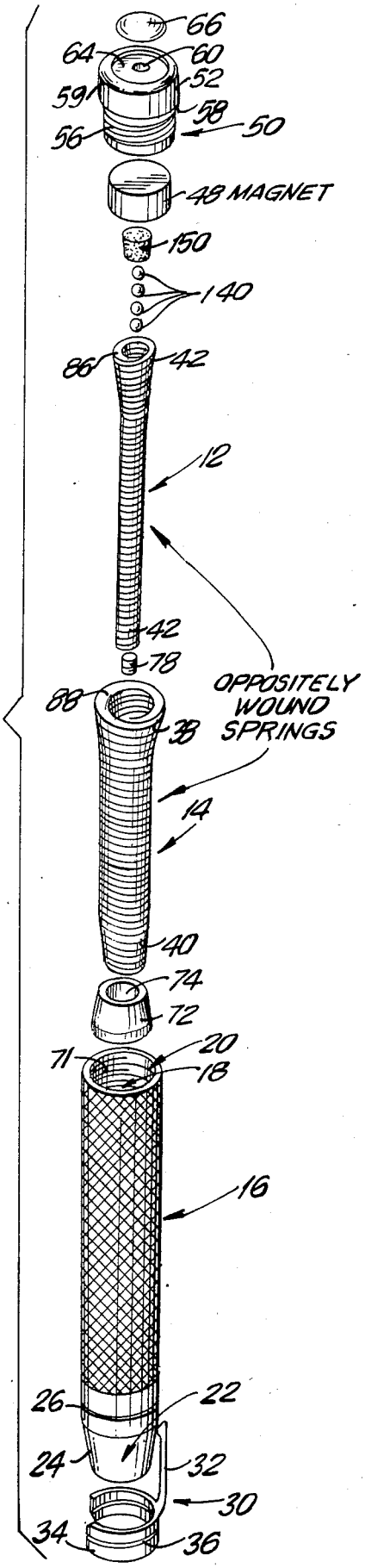
FIG. 2 is an exploded perspective view of the various parts forming the spring whip, in accordance with the present invention.
Figure 3:
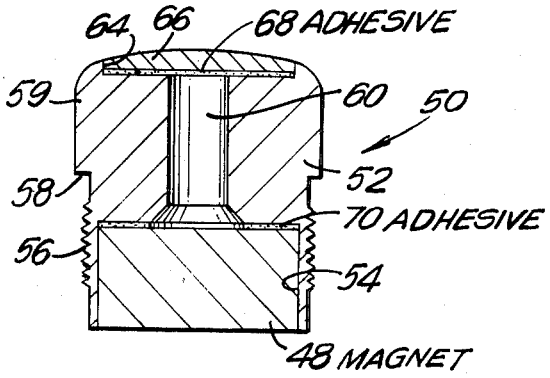
FIG. 3 is a sectional elevational view of the unitary closure unit provided in the top of the housing of the present invention.
Figure 8:
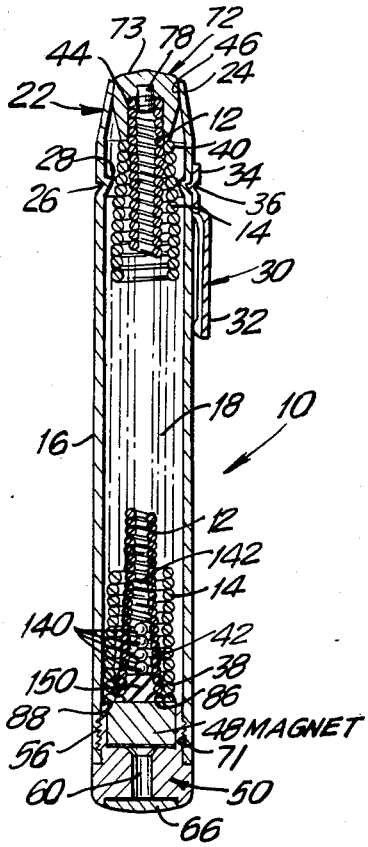
FIG. 8 is a side elevational view showing the spring whip with the spring lengths thereof in the stored position within the hand grip housing.
Figure 11:
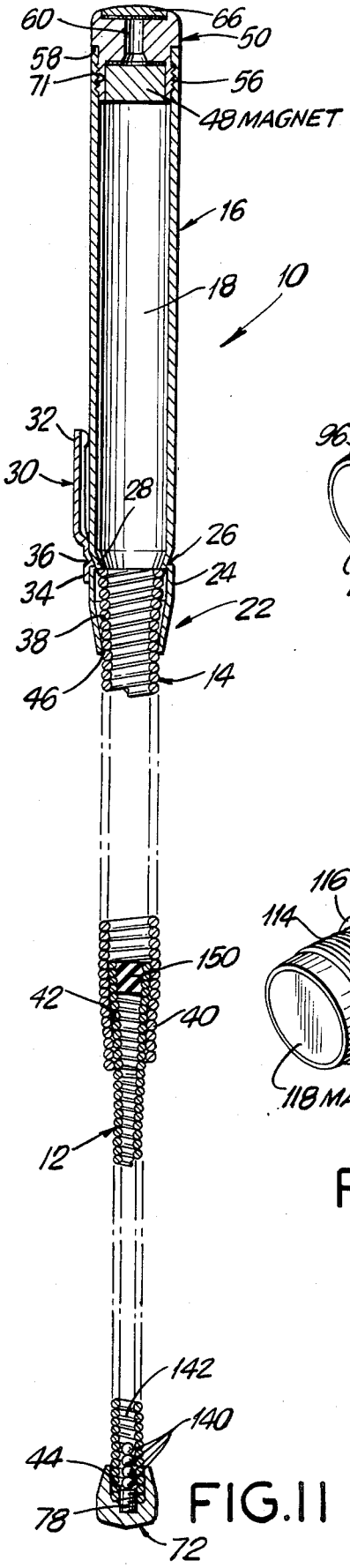
FIG. 11 is a sectional view illustrating the spring lengths in their extended locked position projecting from the hand grip housing.

In the figures, there is shown a defensive weapon, specifically a spring whip generally designated at 10 which is essentially constructed of plural lengths of springs. In the embodiment shown best in FIG. 2, there are provided two spring sections 12, 14 with section 12 being of a smaller diameter than section 14. The two sections are interconnected together in a telescopic arrangement to form a spring subassembly unit. The spring subassembly is inserted into a hollow housing 16, wherein it is retained in its compact, telescoped arrangement, as shown in FIGS. 1 and 8. In this manner, it can be conveniently stored in a small space, such as a purse or a pocket. At the same time, the springs 12, 14 can be conveniently put into use as a whip by extending the springs 12, 14 into their whipping positions, as shown in FIG. 11.

The hollow elongated housing 16 comprises a cylindrical member defining an internal cylindrical shaped storage compartment 18. At one end there is provided an entrance opening 20 while at the other end there is provided a constricting end 22. The constricting end 22 includes a slight tapered portion 24 to provide for a smaller exit opening 46 from which the spring sections 12, 14 will project. There is also provided an annular groove 26 which forms an inwardly projecting annular constriction 28 inside the chamber 18 for locking the extended spring lengths, as will hereinafter be explained.

In order to facilitate retaining the spring whip, there is included a pocket clip 30 having an elongated tongue 32 extending from an annular split resilient retaining ring 34 which can be mounted around the periphery of the hollow housing 16. An indent 36 is formed in the retaining ring for providing a snap-in engagement in the annular groove 26 in order to prevent the pocket clip from sliding along the hollow housing.

The helical spring sections 12, 14 are conventionally wound. However, preferably the spring sections 12, 14 are respectively wound in opposing directions in the manner set forth in my U.S. Pat. No. 4,456,255. The larger spring section 14 has its upper end 38 outwardly flared so as to provide a wider proximal end, and its lower end 40 inwardly tapered to provide a narrower distal end than its central body portion. This can be achieved, by way of example, by making the top few turns of the spring of progressively increasing diameters, while making the last few helical turns at its distal end with progrssively diminishing diameters. The spring section 12 is wound in a clockwise direction commencing at the upper end 38.

The spring section 12 has its upper end 42 outwardly flared so as to be wider than the rest of the body, which is of substantially uniform diameter. The lower distal end 44 is of substantially similar diameter to the rest of the body. In order to achieve the flaring at the upper end, the top few helical turns can be made with progressingly increasing diameters. The spring section 14 is wound in a counter clockwise direction commencing at the upper end 42.

By so shaping the spring sections, the spring sections will form interconnections permitting telescoping of the springs and causing a wedging engagement between the springs in their extended position. Specifically, with regard to spring section 14, the lower narrower diameter portion 40 is permitted to pass through the exit opening 46 at the distal end of the tapered portion 24 of the housing 16, while the upper wider flared end 38 of the spring section 14 is prevented from passing through the exit opening 46 of the housing, as is clearly shown in FIG. 11. In a similar manner, the wider end 42 of the spring section 12 is held by the narrower end 40 of the spring section 14. However, the rest of the spring section 12 is able to pass through the narrower end 40 of the spring section 14.

In this way, the springs can be telescopically positioned one within the other so that both springs have a common axis and thus, the springs can be retained in a stored position within the housing compartment 18, as shown in FIG. 8. Accordingly, in their extended position, there will be wedging engagement of the springs with each other to hold the springs in such extended position, as shown in FIG. 11.

While only two such springs are shown, additional springs could be included, wherein each of the additional springs would be of progressively smaller diameter with respect to the spring immediately above or preceeding it, and with each of the springs being similar to the spring section 14, so that its upper respective end is outwardly flared and wider, while its lower end is inwardly tapered to be narrower than the rest of the body portion. Only the lowermost smallest diameter spring would have a wider upper end with a substantially uniform main body portion similar to the spring section 12. Furthermore, adjacent springs would be wound in opposing directions.

In order to retain the springs in their telescoped storage position within the housing 16, there is provided a magnet 48 at the upper end of the housing. The spring sections 12, 14 are fabricated from a magnetic attracting material.

The magnet 48 is held within a unitary closure unit, shown generally at 50. The closure unit 50, which can be seen in FIGS. 2, 3, 8 and 11, includes a substantially tubular body portion 52 having a substantially cylindrical seat 54 provided in the lower portion for receiving the magnet 48. The lower end of the tubular body portion is externally threaded at 56 while the upper portion is substantially solid. A radially outwardly projecting shoulder portion 58 separates the lower tubular body portion from the upper enlarged cap portion 59. An axial bore 60 having a countersunk bottom portion 62 extends through the upper cap portion 59 and is in communication with the lower seat 54. A recess 64 is provided in the top surface of the cap position 59 in which an insert 66 can be placed such as a decorative disk which may include an emblem or other means of identification. The insert or disk 66 is secured in the recess 64 by means of adhesive cement 68 or the like.

The magnet 48 is substantially cylindrical and provides a tight friction fit in the seat 54. As the magnet is inserted, the air in the seat can escape through the air escapement bore 60. The magnet is retained in place by means of adhesive or cement 70 placed at the bottom of the seat 54.

Figure 4:
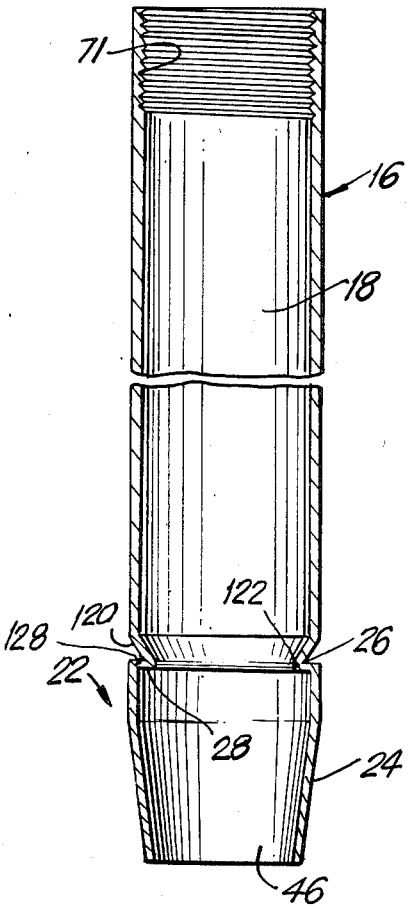
FIG. 4 is a sectional view of the hollow housing member, showing the upper thread for receiving the unitary closure unit, and showing the constriction at its lower end.

In the housing 16, there is provided an internally threaded end 71, as best shown in FIG. 4, for threadably receiving the external threads 56 of the body portion 52 of the closure unit 50. The shoulder 58 is of an appropriate size to correspond to the thickness of the wall of the housing 16 for abutment therewith to function as at stop. With the closure unit 50 threaded in place, the upper head portion 59 serves as a continuous extension of the housing 16, as shown in FIGS. 1, 8 and 11.

Figure 5:
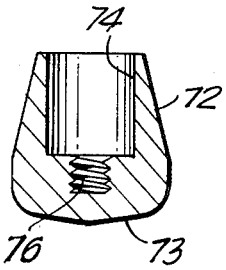
FIG. 5 is a side sectional view, showing the lower closure tip portion which serves as a weighted member for facilitating the projection of the springs, and also serves as a closure member for the lower constricting end of the hollow housing.

A lower portion 72 is provided at the distal end 44 of the smallest diameter spring section 12. The tip portion 72 has a substantially frustroconical configuration with its base being of substantially circular configuration and being of a size substantially equal to, but slightly less than, the lower opening 46 of the housing 16. As shown best in FIG. 5, the tip portion 12 has a smooth internal seat 74 of a size to accommodate the distal end 44 of the spring section 12 which is inserted into the seat 74, as shown in FIGS. 8 and 11. A threaded hole 76 extends into the lower surface of the seat 74, and serves to accommodate an externally threaded stud 78 which is threaded into the hollow interior of the end 44 of the smallest spring section 12.

Figure 6:
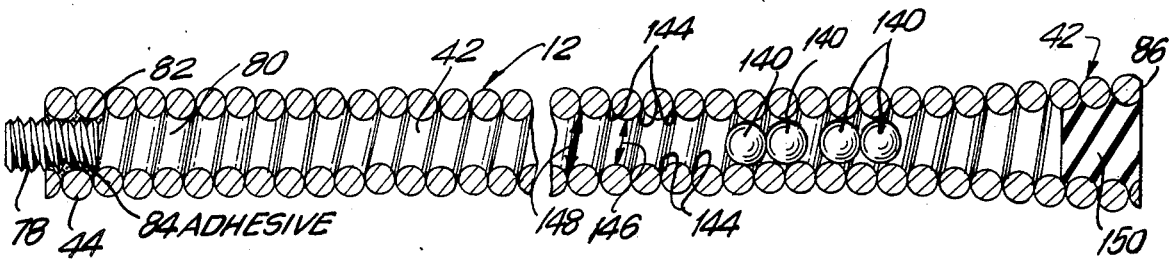
FIG. 6 is a cross sectional view through the smallest diameter length of spring, showing the presence of the weighted bearings sized to helically rotate within the hollow interior of the housing.

As can best be seen in FIG. 6, the externally threaded stud 78 is internally threaded into the hollow portion 80 at the end 44 of the smallest diameter spring section 12, being received by means of internal threads 82. At the same time, additional adhesive or cement 84 can also be included to secure the stud 78 in place.

The tip portion 72 serves as a weighted end of the lengths of springs in order to aid in the projection of the springs into their extended whipping position. At the same time, the tip portion serves as a closure for the lower end of the housing 16, where the tip portion 72 abuts the forward end of the housing 16 and serves to close off the opening 46 thereby providing a smooth finished end to the housing, as best shown in FIGS. 1 and 8. This avoids any hazards to the carrier of the defensive weapon when in a stored condition.

The seat 74 provided in the tip portion 72 has a diameter approximating the outside diameter of the lower end 44 of the smallest spring section 12. The end 44 enters into the seat 74 for a short distance in order to permit the projecting stud 78 to engage into the threaded hole 76 provided at the bottom of the seat 74, whereby the stud 78 is threaded into the hole 76. In so doing, a portion of the forward end 44 of the spring 12 is enclosed by the seat 74. As a result, when the forward tip portion strikes an object, the spring wall 44 absorbs lateral pressure forces that are exerted against the spring in such striking. In this way, the spring will absorb the striking force instead of transferring the striking force to the screw threaded stud 78. This prevents any warping or bending of the stud 78 as well as avoiding damage to the threads of both the stud 78 and the hole 76.

In order to facilitate retaining the springs in their telescoped position stored within the housing, the upper ends of the spring sections 12, 14 are ground flat, as shown at turn 86 at the upper end of the smallest diameter spring section 12, and at turn 88 at the upper end of the largest diameter spring section 14. In this way there will be provided an abutting surface against the outer face of the magnet 48 when in the stored position.

The length of the smallest spring section 12 will be such that with its tip portion 72 assembled thereto, its composite length will be equal to the distance from the magnet 48 to the exit opening 46 of the housing 16, as can be seen in FIG. 8. In this manner, the bottom surface 73 of the tip portion 72 will serve to close the exit opening 46 of the housing 16, and at the same time, the flattened end 86 of the spring section 12 will be abutting the magnet 48. The spring section 14 is shorter by the length of the tip portion 72.

In my aforementioned three previous patents, the spring whip was connected in such a manner that it was factory assembled and once assembled, remained intact without the possibility of any disassembly by the carrier or user thereof. Specifically, the springs provided in all of my aforementioned patents and also in the prior art embodiments were permanently contained within the housing. The closure unit included swedging or crimping of the magnet into the holder, and further provided for welding or other permanent sealing of the cap onto the housing.

Because the prior art units were permanently sealed, a damaged spring whip could not be repaired. Since a lateral blow of the spring on a sharp corner or against a solid object could result in permanent distortion or bending beyond the stress point of the spring, such damaged spring could no longer be telescoped into the housing and returned to the confines of the housing in the stored position. When a prior art spring whip was therefore damaged, it could not be economically repaired, and therefore became useless. Similarly, if the housing itself became dented, the springs could be locked inside and could no longer be extended to the whipping position.

Likewise, when transporting the defensive weapon through various jurisdictions, it is often necessary, because of the laws of the particular jurisdiction, to break down or disassemble the spring whip into its component parts. Thus, the composite assembly may present legal problems to the carrier in crossing jurisdictional boundaries and, therefore, disassembly would be warranted.

The present invention permits complete disassembly of the weapon into its component parts even when the spring lengths are telescopically coupled together into a spring subassembly. It is noted that such subassembly is inserted into the hollow housing through the wide open end of the housing and projects through the tapered constricting end 24 of the housing.

The closure unit 50 of the present invention is provided as a unitary assembly integrally including the magnet 48 as a part of the closure unit itself. The closure unit is threaded into the upper end of the housing to close off the housing, and at the same time to provide the magnetic attraction for maintaining the springs in their telescoped retained position within the housing. Accordingly, should the device be required to be disassembled for repair or transporting, the closure unit 50 can be easily unscrewed from the housing, and the spring sections 12, 14 extracted so as to separate them.

In addition, the previous patents provide that the tip portion is a permanent attachment to the smallest diameter spring section. This also prevented disassembly of the spring subassembly into individual spring lengths. In the present invention, the tip portion 72 is only threadingly attached to the smallest spring section. Accordingly, after the spring subassembly is extracted from the hollow housing by removal of the closure unit 50, the spring subassembly itself can be disassembled into its various individual spring sections by removing the tip portion 72. This permits extraction of the smallest diameter spring section, and thereby permits the other spring section or sections to be similarly taken apart from each other.

A special feature of the present arrangement is the ability to disarm and defeat efforts at reassembly of the device, such as might be attempted by children or unauthorized persons. After the spring subassembly has been removed from the housing and the tip portion 72 is unscrewed from the smallest diameter spring so that all of the spring lengths are separated from each other, the tip portion 72 is again attached. By rescrewing the tip portion 72 back onto the smallest spring length 12 after the spring section 12 has been separated from the other springs, the smallest diameter spring will now be prevented from being reassembled into the other springs and thereby prevents reassembly of the entire subassembly. In this manner, those not familiar with this feature will find it impossible to reconnect the various spring lengths, thereby providing an additional safety and security feature preventing reassembly by unauthorized individuals.

Because the entire closure unit is of a single unitary assembly, the entire closure unit itself can also be replaced should it become damaged. Frequently, it has been found, that as a result of the continuous abutting of the spring lengths onto the outer face of the magnet, there can result a tendency of the outer face of the magnet to flake. This could then affect the telescoping action of the springs. In the present invention, by simply removing the entire closure unit, and replacing it with a new closure unit, which can be easily screwed into the hollow housing to close it off, the magnet can be replaced easily without the necessity of having a factory provide for the replacement.

Because of the unitary nature of the closure unit, additional types of closure units can be threaded into the housing, thus providing for an easy replacement of the original closure unit 50. For example, referring to FIG. 12, there is provided a closure unit 90 including a substantially cylindrical body portion 92 projecting for a greater extent than the abovementioned standard closure portion 52 shown in FIG. 2. The upper end of closure unit 90 terminates in a substantially circular head portion 94 so that the closure unit 90 can serve as a bludgeon unit. The lower end of the closure unit 90 has a smaller diameter body portion 96 provided with an external thread 98 similar to the above-mentioned thread 56. The body portion 96 is inserted into the housing 16 and serves to threadably engage the internal threads 71 contained within the housing. The magnet 100 would be appropriately inserted into a seat provided within the bottom of the body portion 96.

Figure 13:
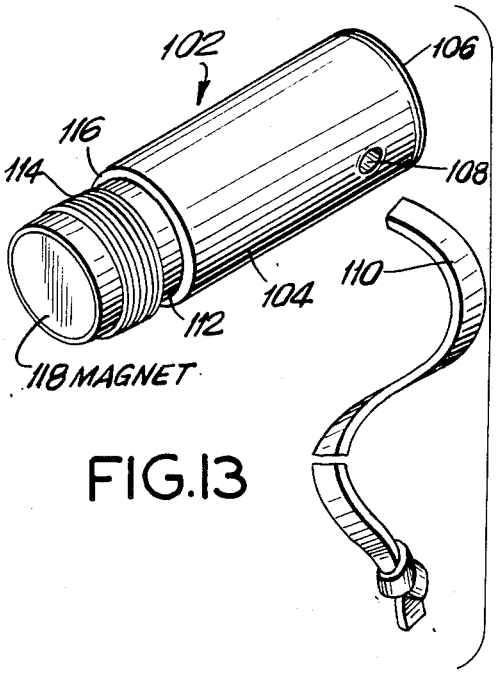
FIG. 13 is a perspective view of yet another unitary closure unit in the form of a hand grip and strap.

FIG. 13 shows yet a further closure unit 102 again including an elongated cylindrical body portion 104 having a substantially flat upper end 106. A radially extending hole 108 passes through the body portion 104 for receiving a strap 110. The lower body portion 112 has an external thread 114. The shoulder 116 separates the upper body portion 104, which projects from the hollow housing 16, from the lower body portion 112, which is threadably received into the hollow housing 16. The magnet 118 is secured in a seat provided in the bottom of the body portion 112.

Figure 12:
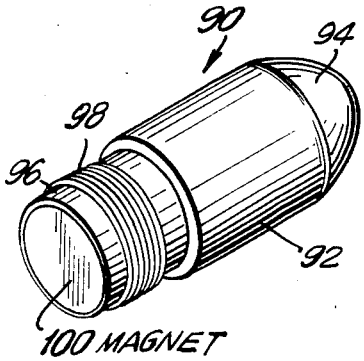
FIG. 12 is a perspective view of a modified unitary closure unit for removably closing the open end of the hollow housing, and including a bludgeon as an additional defensive weapon.

In addition to the bludgeon type head unit 90 shown in FIG. 12, and the gripping unit 102 shown in FIG. 13 which could be used as a club or nightstick, other types of closure units could also be suitably inserted into the housing 16. Each of the closure units could be screwed directly into the end of the hollow housing 16 thereby replacing the standard closure unit 50. Each of these closure units would have its own magnet, whereby each of the closure units serves as a self-magnetic accessory.

These self-magnetic accessory closure units have a strong connective strength because the thread diameter of the accessory part is equal to the entire interior diameter of the housing. Furthermore, all such accessory closure units are interchangeable. They are connected directly into the housing and do not require any additional connector or adaptor to be fitted into the housing. They are all self-magnetic, with each containing its own magnet to hold the telescoped springs in place within the housing. This also permits a wide range of optional functions for the device in addition to the primary self-defense function of the spring whip.

As heretofore explained, when projecting the spring whip into its extended whipping position, the wide end 38 of the largest diameter spring section 14 wedgingly engages the tapered constricting end 24 of the hollow housing 16. This provides an engagement to retain the springs in their extended position projecting from the housing. However, should the extended whipping springs axially press against an object, the force of such pressure may overcome the wedging action and serve to collapse the springs, thus causing them to telescope into the housing, thereby losing their striking efficiency.

Figure 9:
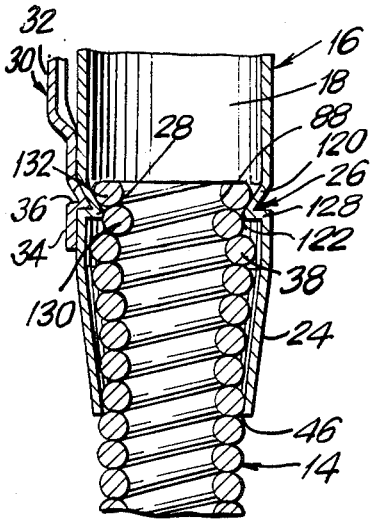
FIG. 9 is an enlarged cross sectional view, showing the wedging engagement of the largest diameter length of spring with the constricting end of the hollow housing prior to its being locked in place.
Figure 10:
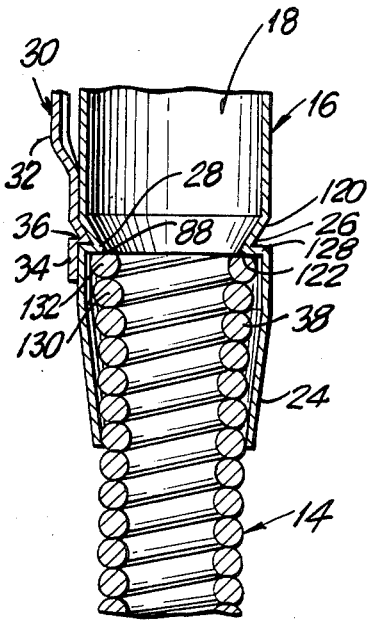
FIG. 10 is a view similar to that shown in FIG. 9, showing the length of spring locked in place beneath the annular ridge.

Therefore, as shown in FIGS. 9 and 10, in addition to the wedging action, the present spring whip 10 provides for a positive locking action following the wedging of the wide end 38 of the spring section 14 into the narrow tapered portion 24 of the housing 16. The positive locking action is provided by means of the external groove 26 which provides the inner projection 28 within the hollow compartment 18 of the housing 16. The inner projection 28 resulting from the external groove 26 includes an inwardly directed, fowardly projecting wall portion 120 which serves as a cam surface terminating at the innermost constriction 122. There is then provided a radially outwardly projecting ledge portion 128. The inner diameter of the narrowest constriction 122 is smaller than the outer peripheral diameter of at least one of the coil turns at the outwardly flared projecting end 38 of the spring section 14.

Specifically, in the embodiment shown, the diameter of the penultimate spring turn 130 is such as to have a clearance fit between the innermost constriction 122, while the diameter of the ultimate coil turn 132 has an interference fit therewith. In this manner, as the springs project from the hollow housing, all of the coil turns will pass through the innermost constriction 122 with the penultimate coil turn 130 being the last coil to easily pass beyond the narrow constriction 122. Since the ultimate coil turn 132 has a wider diameter, it will interfere with the constriction 122 and will not easily pass through the constriction 122.

However, the axial force exerted on the spring section 14 during the projection thereof from the housing 16, will cause the ultimate coil turn 132 to be compressed as the ultimate coil turn 132 passes the constriction 122. The inner angled cam wall 120 will aid in the compression of the ultimate coil turn 132. As soon as the coil turn 132 has passed beyond the innermost constriction 122, it will be permitted to expand back to its normal configuration, and will then lock beyond the ledge portion 128 of the projection 28. In this manner, the spring section 14 will be locked in the projected position and will not be able to be easily collapsed and retelescoped back into the hollow housing. Accordingly, any external pressure applied on the spring section 14 will force the spring turn 132 against the ledge portion 128, and thus retain it in place within the housing 16 with the spring section 14 projecting from the housing.

Nevertheless, in order to return the spring lengths to their telescoped position, all that is necessary is to rotate the spring section 14 in the same direction as its winding turns are formed, and the coil turn 132 will be threaded back past the constriction 122. This will release the springs from their locked position and permit the telescoping of the springs back into the housing 16.

It is noted that the movement into the locked position takes place with an adequate thrust of the coil springs when being projected into the whipping position. Depending upon the force applied during the projection of the springs from their telescoped to their extended position, both the wedging action and the locking action can be achieved without any extra necessity of yanking the springs into the locked position.

In order to provide increased striking force, the aforementioned U.S. Pat. No. 3,554,546 described the use of plural weights which are slidably disposed within the hollow interior of the narrowest spring, being confined to this area by inwardly bent portions of the spring at its opposing ends. As the spring was projected into its extended whipping position, the weights would slide forward to provide an increased force to any striking action that may occur at the tip of the spring.

Referring now to FIG. 6, it is shown that there are provided a plurality of weighted ball bearings 140 which are contained internally within the hollow interior 142 of the narrowest spring section 12. However, the external diameter of the ball bearings 140 is larger than the internal diameter of the spring section 12 from coil to coil. In this manner, the ball bearings 140 cannot slide within the hollow interior 142 in the spring section 12.

It is noted, however, that between each of the adjacent coil spring turns, there is provided a groove 144. As is evident, the internal diameter at the groove portions is greater than the internal diameter at the crest portion of the spring turns. Specifically, the crest portion of the coil turns is shown at 146 while the internal diameter at the groove portion is shown at 148. The diameter of the weighted ball bearings 140 are made greater than 146 but less than 148. In this manner, the ball bearings 140 cannot slide through the hollow interior 142 of the spring section 12, but can helically track the grooves 144 by tracing the spiral path of the grooves 144 between the coil spring turns.

Because of the helical movement of the bearings in going from one end of the spring to the other, a specific time delay is introduced in the movement of the ball bearings 140. In this manner, by tipping the springs downward before and/or after the springs are projected, the ball bearings will preload the striking end. This will thereby aid in the striking force by providing a heavier impact. Furthermore, the bearings will remain in place at the striking end while the spring whip is in motion in any direction, and will not easily slide away from the striking spring tip despite some movement of the spring tip. It is only when the tip end of the spring whip is retained in an upward position for a sufficient length of time, as shown in FIG. 8, that the bearings will then helically roll to the opposite end, but will again become self-preloading when the device is held stationary with the striking spring tip in a downward position for a short interval of time as shown in FIG. 11.

The number of ball bearings used determines the timing of the spring preload and unload modes. For example, the time delay using five ball bearings was found to be precisely 2.3 seconds. This would also depend upon the length of the spring in which it is loaded.

To fix the ball bearings 140 permanently within the confines of the striking spring, the threaded stud 78 at one end serves as a closure member for the forward distal end of the spring section 12. At the opposing end, a seal 150 is inserted. Typically, the seal 150 can be formed of a composition rubberoid material which is machined to the precise configuration of the cone shaped opening at the proximal end 42 of the spring section 12. The seal 150 can be mechanically wedged into the open end of the spring section 12 after the spring is loaded with a predetermined number of steel ball bearings 140. This provides a secure permanent seal to retain the ball bearings in place.

In using the ball bearings, it has been found that numerous advantages can be achieved. Since the bearings are not mechanically connected to one another, the spring section 12 retains its full flexibility with the ball bearings rolling apart as the spring bends. Thus, the spring section 12 is never transformed into a club, nor can it inflict the type of injury associated with a solid or lead filled blunt instrument. Nevertheless, by the addition of the ball bearings, additional striking force is provided to the flexible spring, and thus the spring whip 10 becomes a better defensive weapon for use where violent reactive deployment becomes necessary.

Figure 7:
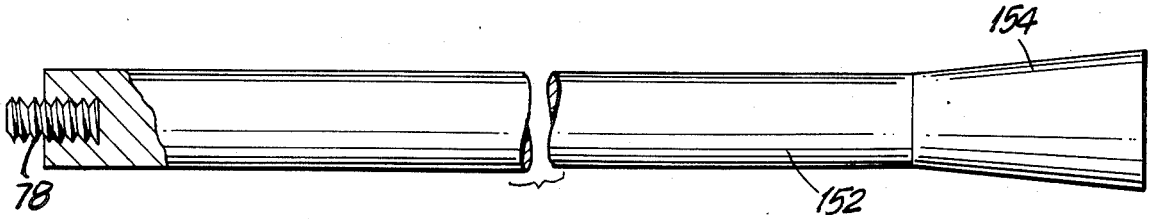
FIG. 7 is a partially sectioned side view of a solid rod for use in place of the smallest diameter length of spring, serving as the striking rod of the spring whip.

When a more powerful striking device is required, a solid steel shaft can be used in place of the forward narrowest diameter striking spring section 12. As best shown in FIG. 7, a substantially solid rod member 152, preferably steel, is shown for use in place of the narrowest smallest diameter spring section 12 which normally serves as the striking portion of the spring whip 10. At the forward end of the rod member 152, there is again provided the externally threaded stud 78 for threaded engagement between the rod member 152 and the tip member 72 shown in FIG. 5. The stud 78 is threaded into a threaded bore provided in the forward end of the rod member 152, where an adhesive can be used if required. The proximal end of the rod member 152 is outwardly flared at 154 to provide the wedging engagement with the narrowing tapered end 40 of the next adjacent spring section 14 to which the rod member 152 would be connected.

Since the solid rod member 152 of FIG. 7 would be connected to another flexible spring member, such as the spring section 14, there is still provided the necessary swing or whip action to the spring whip. However, because of the presence of the steel rod member 152 serving as the striking portion, the impact delivered thereby is substantially greater. However, the shock that would normally be transmitted to the hand grip or housing of a solid steel unit is reduced by the presence of the spring action of the adjacent spring section 14.

In place of the rod member 152 being steel, other types of solid materials could be utilized, such as a graphite fiber. The graphite fiber would provide a lightweight but strong material, thereby producing all of the desired deterent and protective results when used in combination with the spring section 14, wherein the weight of the spring whip would be lessened.

In the construction of the improved magnetic spring whip, it is possible to form the spring fabrication from carbon steel, piano wire, and/or tungsten steel, as well as other possibilities for use in special applications and special requirements.

As best shown in FIG. 1, the exterior of the housing 16, which serves as a handgrip, is provided with a knurled surface 156. Such knurled surface 156 improves the quality and performance of the hand grip. Typically, engraving wheels would be used to knurl lines into the surface in counter directions to form a typically diamond checkered pattern, as shown, with a sharp gripping surface. The lines would be knurled to a limited depth that would not collapse the inner surface or internal diameter of the housing 16. The resulting sharply knurled handgrip can be made rustproof to protect the surface 156. The surface 156 can also be decorated by various processes. For example, black oxidizing on steel can be used to evenly coat the housing 16 to provide the surface 156 with a black, rust resistant finish, which would also coat and protect the checkered pattern or texture in the situation where the grating or knurling process exposed the raw material of the housing.

Anodizing could also be utilized. When the handgrip is fabricated from a light alloy, the anodizing enables the production of a protective coating which, unlike oxidizing, produces a variety of colors rather than the black color normally attained with the oxidizing process of steel. The result can be an attractive appearance and superior handling, without the rapid deterioration of the finish due to the relative performance of the engraved handgrip now provided in the prior art methods used.

Another alternate decoration and finish process allows for the production of special collectors models of the product, such as by using various methods including plating with precious metals such as gold and silver, or plating with chromium.

When black oxidizing, anodizing, or precious metal plating processes are utilized, a superior and more even and longer lasting rust resistant finish is achieved than possible with normal painting. At the same time, a rust preventative coating is also produced on the inside surface of the housing 16, so that the problem of rust or oxidation on the inside surface of the housing is greatly reduced or eliminated. This inside surface coating does not measurably change the critical internal diameters or dimensions so as to interfere with the passage therethrough of the helical springs contained therein. This is not possible or practical with spray painting, or even with dip painting, since a coat of paint thin enough to allow the passage of the springs therethrough, would rapidly wear off due to the friction caused by the spring bearing directly against the painted surface. It is also obvious that any of the above mentioned alternative methods of coating, as a substitute for the application of paint, would allow for a finish that would not result in any paint filling the diamond checkered pattern. Such paint filling would reduce the effectiveness of the pattern as a handgrip, where such paint filling obviously would occur with the use of a paint coating.

Numerous alterations of the structure herein disclosed will suggest themselves to those skilled in the art. However, it is to be understood that the present disclosure relates to a preferred embodiment of the invention which is for purposes of illustration only, and is not to be construed as a limitation of the present invention.

What is claimed is:

1. A knock down spring whip assembly comprising:

a hollow housing serving as a handgrip and providing an internal storage compartment;

at least two elongated members of sequentially increasingly larger diameter size for telescopic arrangement into a coaxial subassembly slidably insertable into said storage compartment, at least one of said elongated members being a helically wound spring;

engaging means to provide for a wedging engagement of said elongated members in an extended whipping position when projecting from a first end of said housing;

means preventing said subassembly from passing entirely through said first end of said housing;

closure means permitting said subassembly to be removed from said housing at an opposite second end of said housing, said closure means including a removable closure unit for plugging said second end;

a weighted tip having a circular seat receiving a distal end of the elongated member with the smallest diameter, said tip and said engaging means preventing said elongated member with the smallest member from being disassembled from the adjacent elongated member with a larger diameter;

removal means permitting said tip to be removed from said distal end of said elongated member with the smallest diameter so that said subassembly can be disassembled into its component parts;

said closure unit including retaining means for retaining said subassembly in said telescopic arrangement within said storage compartment; and said housing including constraining means projecting into said storage compartment adjacent said first end to abut against an ultimate loop turn of said spring to prevent said spring from returning into said storage compartment when in said extended whipping position, said spring being the elongated member with the largest diameter;

whereby said closure unit, said component parts of said subassembly, said tip and said hollow housing can all be disassembled from each other and replaced.

2. A knock down spring whip assembly as in claim 1, wherein said closure unit includes a bludgeon projecting from said second end of said housing.

3. A knock down spring whip assembly as in claim 1, wherein said closure unit includes a longitudinally extending body member projecting from said second end of said housing, and strap means coupled to said body member.

4. A knock down spring whip assembly as in claim 1, wherein a magnet is securably positioned in said closure unit to define said retaining means, and wherein said elongated members are fabricated from a magnetic attracting material.

5. A knock down spring whip assembly as in claim 4, wherein said magnet provides a friction fit within said closure unit, an axial air escapement hole provided through a head portion of said closure unit and communicating with a seat in said closure unit for receiving said magnet so that said magnet can be inserted into said closure unit seat.

6. A knock down spring whip assembly as in claim 1, wherein an outermost end of said tip is of a size substantially equal to an opening in said first end of said housing to close said opening when said elongated members are retained in said telescopic arrangement.

7. A knock down spring whip assembly as in claim 1, wherein said circular seat closely proximates an exterior portion of said smallest diameter elongated member so that upon striking impact of said tip, striking force thereof is transferred to said smallest diameter elongated member.

8. A knock down spring whip assembly as in claim 1, wherein the elongated member with the smallest diameter is a solid rod member.

9. A knock down spring whip assembly as in claim 1, wherein said housing has a knurled exterior surface.

10. A spring whip comprising:

a hollow housing serving as a handgrip and providing an internal storage compartment;

at least two elongated members of sequentially increasingly larger diameter size being operatively arranged relative to each other about a common axis so as to be movable between a telescoped storage position within said hollow housing and an extended whipping position projecting from one end of said hollow housing;

said elongated members including engaging means for end to end interconnection of adjacent elongated members in said extended whipping position;

the elongated member with the largest diameter being a helically wound spring;

constraining means on said housing for securing said spring in said extended whipping position;

said constraining means being displaced in a spaced position from said one end of said hollow housing;

said constraining means including abutment means for locking said largest diameter spring in said extended whipping position, said abutment means including an annular constriction projecting into said housing adjacent said one end;

a proximal end of said largest diameter spring being outwardly flared with at least one loop turn thereof having an interference fit with said annular constriction so that an axial force on said spring compresses said one loop turn to pass through said annular constriction and to lock in place beyond said annular constriction, said annular constriction preventing said spring from returning into said storage compartment; and said annular constriction including an inwardly projecting cam surface terminating in a radially directed shoulder so that said one loop turn is compressed along said cam surface and locks beyond said shoulder in said extended whipping position, and can be released by rotating said spring in its winding direction.

11. A spring whip as in claim 10, wherein said constraining means also includes wedging means to provide a wedging engagement of said spring within said one end of said housing, said one end of said housing being inwardly tapered, and said proximal end of said largest diameter spring which is outwardly flared provides for said wedging engagement therebetween.

12. A spring whip as in claim 10, wherein said annular constriction is an annular groove struck into an exterior of said hollow housing.

13. A spring whip as in claim 12, and further comprising a pocket clip including a retaining ring fitting around said hollow housing, and at least one indent provided on said retaining ring for engaging in said annular groove to prevent axial slippage of the pocket clip.

14. A spring whip as in claim 10, wherein said housing has a knurled exterior surface.

15. A spring whip comprising:

a hollow housing serving as a handgrip and providing an internal storage compartment;

at least two elongated members of sequentially increasingly larger diameter size being operatively arranged relative to each other about a common axis so as to be movable between a telescoped storage position within said storage compartment and an extending whipping position projecting from one end of said hollow housing;

at least one of said elongated members being a helically wound spring having a hollow interior;

means providing a helical path within said spring about its axis from one end of said spring to an opposite end thereof, said means including internal grooves between adjacent loop turns of said spring;

a plurality of weighted ball bearings each having a diameter greater than internal diameter between opposing ones of said spring loop turns to prevent said ball bearings from freely transversing in a longitudinal direction along said spring axis through said hollow interior of said spring, and said diameter of each of said ball bearings being less than internal diameter between opposing ones of said internal grooves between said adjacent loop turns of said spring;

said ball bearings being disposed in said hollow interior of said spring to track said internal grooves between said adjacent loop turns of said spring to thereby trace said helical path within said spring when moving from said one end of said spring to said opposite end thereof to effect a time delay in the movement of said ball bearings from said one end to said opposite end of said spring; and closure means for containing said ball bearings within said spring;

said spring being the elongated member with the smallest diameter size to constitute a striking spring to provide an additional striking force at a distal end of said spring whip.

16. A spring whip as in claim 15, wherein said closure means includes an externally threaded stud projecting from a distal end of said striking spring for threadably engaging in a tip member disposed on said striking spring, and a sealing plug at the opposite end of said striking spring.

17. A spring whip as in claim 16, wherein said opposite end of said striking spring is flared to provide a wedging engagement with a distal end of an adjacent spring, and wherein said sealing plug is a rubberoid material and is frustroconical in shape to frictionally fit into said flared end.

18. A spring whip as in claim 16, wherein said threaded stud is threaded into said distal end of said striking spring.

19. A spring whip comprising:

a hollow housing serving as a handgrip and providing an internal storage compartment;

at least two elongated members of sequentially increasingly larger diameter size being operatively arranged relative to each other about a common axis so as to be movable between a telescoped storage position within said hollow housing and an extending whipping position projecting from one end of said hollow housing;

said elongated members including engaging means for end to end interconnection of adjacent elongated members in said extended whipping position;

the elongated member with the largest diameter being a helically wound spring;

constraining means on said housing for securing said spring in said extended whipping position;

said constraining means including abutment means for locking said largest diameter spring in said extended whipping position, said abutment means including an annular constriction projecting into said housing adjacent said one end;

a proximal end of said largest diameter spring being outwardly flared with at least one loop turn thereof having an interference fit with said annular constriction so that an axial force on said spring compresses said one loop turn to pass through said annular constriction and to lock in place beyond said annular constriction, said annular constriction preventing said spring from returning into said storage compartment;

said annular constriction including an inwardly projecting cam surface terminating in a radially directed shoulder so that said one loop turn is compressed along said cam surface and locks beyond said shoulder in said extended whipping position, and can be released by rotating said spring in its winding direction; and a penultimate loop turn of said spring having a clearance fit with said annular constriction, and said one loop turn being an ultimate loop turn of said spring.

* * * * *